US009828225B2

(12) United States Patent
Taki et al.

(10) Patent No.: US 9,828,225 B2
(45) Date of Patent: Nov. 28, 2017

(54) APPARATUS FOR CONTROLLING LOAD HANDLING DEVICE

(71) Applicant: KABUSHIKI KAISHA TOYOTA JIDOSHOKKI, Kariya-shi, Aichi-ken (JP)

(72) Inventors: Yasuhiro Taki, Aichi-ken (JP); Tadashi Yamada, Aichi-ken (JP); Takashi Nishiwaki, Aichi-ken (JP); Junichi Kuwayama, Aichi-ken (JP); Hidenori Oka, Aichi-ken (JP); Kimihide Hasegawa, Aichi-ken (JP); Hiroshi Murata, Aichi-ken (JP)

(73) Assignee: KABUSHIKI KAISHA TOYOTA JIDOSHOKKI, Kariya-shi (JP)

( * ) Notice: Subject to any disclaimer, the term of this patent is extended or adjusted under 35 U.S.C. 154(b) by 35 days.

(21) Appl. No.: 14/876,096

(22) Filed: Oct. 6, 2015

(65) Prior Publication Data

US 2016/0101970 A1 Apr. 14, 2016

(30) Foreign Application Priority Data

Oct. 8, 2014 (JP) ..... 2014-207236

(51) Int. Cl.
*B66F 17/00* (2006.01)

(52) U.S. Cl.
CPC ..... *B66F 17/003* (2013.01)

(58) Field of Classification Search
None
See application file for complete search history.

(56) References Cited

U.S. PATENT DOCUMENTS 4,517,645 A * 5/1985 Yuki ..... B66F 9/0755 414/273
6,135,694 A * 10/2000 Trego ..... B66F 9/24 414/21
2012/0107077 A1* 5/2012 Alveteg ..... B66F 9/0755 414/667
2013/0085646 A1* 4/2013 Nishiwaki ..... B66F 9/082 701/50

(Continued)

FOREIGN PATENT DOCUMENTS

EP 2574589 A1 4/2013
JP 2001-206695 A 7/2001
JP 2008280146 A * 11/2008

OTHER PUBLICATIONS

Communication dated Apr. 15, 2016, from the European Patent Office in counterpart application No. 15188498.8.

*Primary Examiner* — Ryan Rink
(74) *Attorney, Agent, or Firm* — Sughrue Mion, PLLC

(57) ABSTRACT

An apparatus for controlling a load handling device of an industrial vehicle is provided. The load handling device includes a mast assembly and a load handling attachment attached to the mast assembly. The apparatus includes a tilt angle detector that detects a tilt angle of the mast assembly, a controller that regulates a lifting speed of the load handling attachment, and a determination device that determines whether or not the load handling attachment is being lifted off the ground. When the determination device determines that the load handling attachment is being lifted off the ground, the controller permits the load handling attachment to be lifted at a speed faster than the regulated lifting speed.

5 Claims, 4 Drawing Sheets

(56) References Cited

U.S. PATENT DOCUMENTS

| | | | | |
|---|---|---|---|---|
| 2013/0211679 | A1* | 8/2013 | Gerdes | B66F 9/07559 701/50 |
| 2016/0083233 | A1* | 3/2016 | Yamada | B66F 9/07568 414/664 |

* cited by examiner

APPARATUS FOR CONTROLLING LOAD HANDLING DEVICE

BACKGROUND OF THE INVENTION

The present invention relates to an apparatus for controlling a load handling device that is provided in an industrial vehicle.

Forklift trucks have been used widely as an industrial vehicle that performs load handling operations (picking up and placing of loads) in a warehouse. In a forklift truck, operation of lifting the forks having thereon a load with the mast assembly tilted forward may affect the operational stability of the forklift truck. Japanese Unexamined Patent Application Publication No. 2001-206695 discloses an overturning alarm device for an industrial vehicle. The tilt angle of the mast assembly of the industrial vehicle is determined based on the detected tensile force acting on the tilt cylinder that causes the mast assembly to tilt and an alarm is issued when the tilt angle of the mast assembly exceeds a predetermined value.

In addition to issuing an alarm, a method for regulating the lifting speed of the forks when the tilt angle of the mast assembly exceeds a predetermined angle has been proposed in the art. According to this method, the regulated lifting speed of the forks is felt by an operator of the forklift truck, who is then prompted to tilt the mast assembly backward.

However, regulating the lifting speed of the forks poses a drawback in that the working efficiency of the forklift truck in the load handling operation may be lowered. Therefore, the lifting speed of the forks should preferably be not regulated as long as operational stability of the forklift truck is secured.

The present invention is directed to providing an apparatus for controlling a load handling device in a forklift truck that enhances the operational stability of the forklift truck while maintaining the working efficiency in load handling operation.

SUMMARY OF THE INVENTION

In accordance with an aspect of the present invention, there is provided an apparatus for controlling a load handling device of an industrial vehicle. The load handling device includes a mast assembly and the load handling attachment attached to the mast assembly. The apparatus for controlling the load handling device controls tilting operation of the mast assembly and lifting and lowering operation of the load handling attachment. The apparatus for controlling the load handling device includes a tilt angle detector, a controller, and a determination device. The tilt angle detector detects a tilt angle of the mast assembly. The controller regulates a lifting speed of the load handling attachment when a forward tilt angle of the mast assembly is greater than a predetermined regulation tilt angle. The determination device determines whether or not the load handling attachment is being lifted off the ground. When the determination device determines that the load handling attachment is being lifted off the ground, the controller permits the load handling attachment to be lifted at a speed that is faster than the regulated lifting speed.

Other aspects and advantages of the invention will become apparent from the following description, taken in conjunction with the accompanying drawings, illustrating by way of example the principles of the invention.

DETAILED DESCRIPTION OF THE EMBODIMENTS

First Embodiment

The following will describe an apparatus for controlling a load handling device according to a first embodiment of the present invention with reference to the accompanying drawings.

Figure 1:
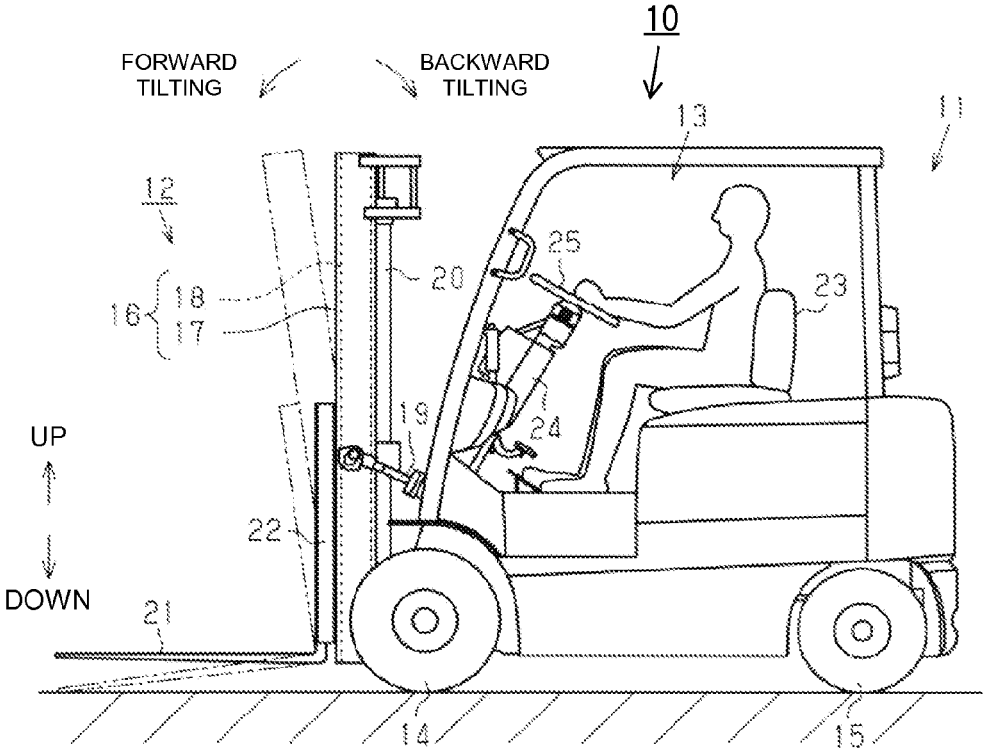
FIG. 1 is a side view of a forklift truck according to a first embodiment of the present invention.
Figure 2:
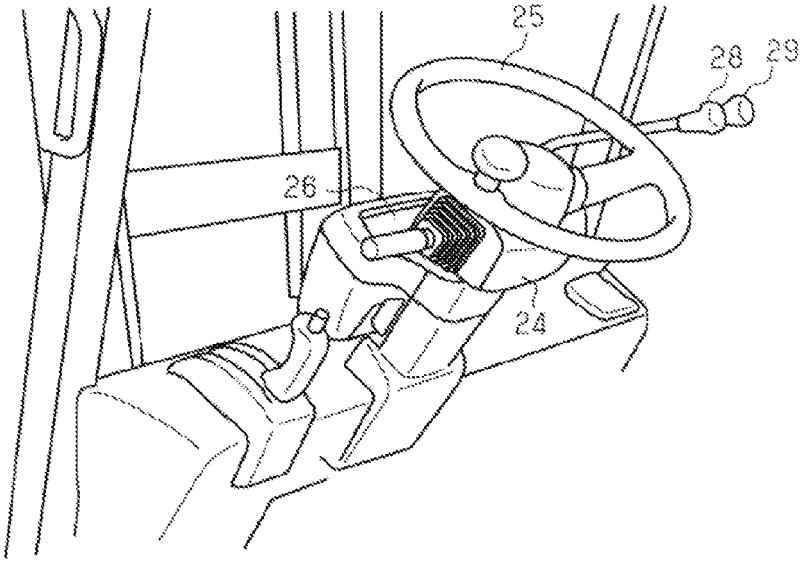
FIG. 2 is a perspective view of a cabin of the forklift truck of FIG. 1.

Referring to FIGS. 1 and 2, the forklift truck as an industrial vehicle of the present invention, which is designated generally by 10, includes a vehicle body 11 and a load handling device 12 installed to the front of the vehicle body 11. The vehicle body 11 has in the center thereof a cabin 13. Drive wheels (front wheels) 14 and steerable wheels (rear wheels) 15 are provided in the front lower part and the rear lower part of the vehicle body 11, respectively. A drive source, such as an engine or a traction motor, is accommodated in the vehicle body 11 and coupled to the drive wheels 14 for driving the drive wheels 14.

The load handling device 12 includes a mast assembly 16 that is vertically provided at the front of the vehicle body 11. The mast assembly 16 includes a pair of right and left outer masts 17 and a pair of right and left inner masts 18, forming a multi-stage mast assembly (two-stage mast assembly in the first embodiment). Each outer mast 17 is connected with its hydraulic tilt cylinder 19 that causes the outer mast 17 to tilt forward and backward with respect to the vehicle body 11. Each inner mast 18 is connected with its hydraulic lift cylinder 20 that causes the inner mast 18 to slide up and down in its corresponding outer mast 17. A pair of forks 21 is mounted to the mast assembly 16 through a lift bracket 22 that is mounted to the inner masts 18 such that the lift bracket 22 is movable up and down. A load handling operation (picking up and placing of loads) herein refers to picking up a pallet (not shown) having thereon a load and placing the pallet to a predetermined position. The inner masts 18 are moved up and down along the outer masts 17 by the operation of the lift cylinder 20 to thereby move up and down the forks 21 together with the lift bracket 22. The forks 21 are tiltable forward and backward with the mast assembly 16 according to the operation of the tilt cylinder 19.

The cabin 13 has therein an operator's seat 23 on which an operator of the forklift truck 10 may be seated. A steering column 24 is provided in front of the operator's seat 23 in the cabin 13. The steering column 24 is provided at the top thereof with a steering wheel 25. The traveling direction of the forklift truck 10 is changed by changing the steering angle of the steerable wheel 15. A display device 26 is mounted to the steering column 24. The display device 26 shows by image various information of the forklift truck 10 (e.g. the vehicle speed and some error information).

A lift lever 28 and a tilt lever 29 are provided on the right of the steering column 24. The lift lever 28 is operated to lift the load handling device 12 (the forks 21). The tilt lever 29 is operated to tilt the load handling device 12 and hence the mast assembly 16 forward and backward. The lift lever 28, which is normally placed in the neutral position, is tiltable to a position directing lifting or lowering of the forks 21. The lift cylinder 20 is operated (extended or retracted) according to the direction to which the lift lever 28 is moved. When the lift lever 28 at the lifting or the lowering position is returned to the neutral position, the motion of the lift cylinder 20 is stopped with the forks 21 at the lifted or lowered position. When the lift lever 28 is at the neutral position, no instruction is made to lift or lower the forks 21.

The tilt lever 29, which is normally placed in the neutral position, is tiltable to a position directing tilting forward or backward. The tilt cylinder 19 is operated (extended or retracted) according to the direction to which the tilt lever 29 is operated. When the tilt lever 29 at a position directing tilting the mast assembly 16 forward or backward is returned to the neutral position, the motion of the tilt cylinder 19 is stopped at the forward or backward tilted position. When the tilt lever 29 is at the neutral position, no instruction is made to the mast assembly 16 to tilt forward or backward.

Figure 3:
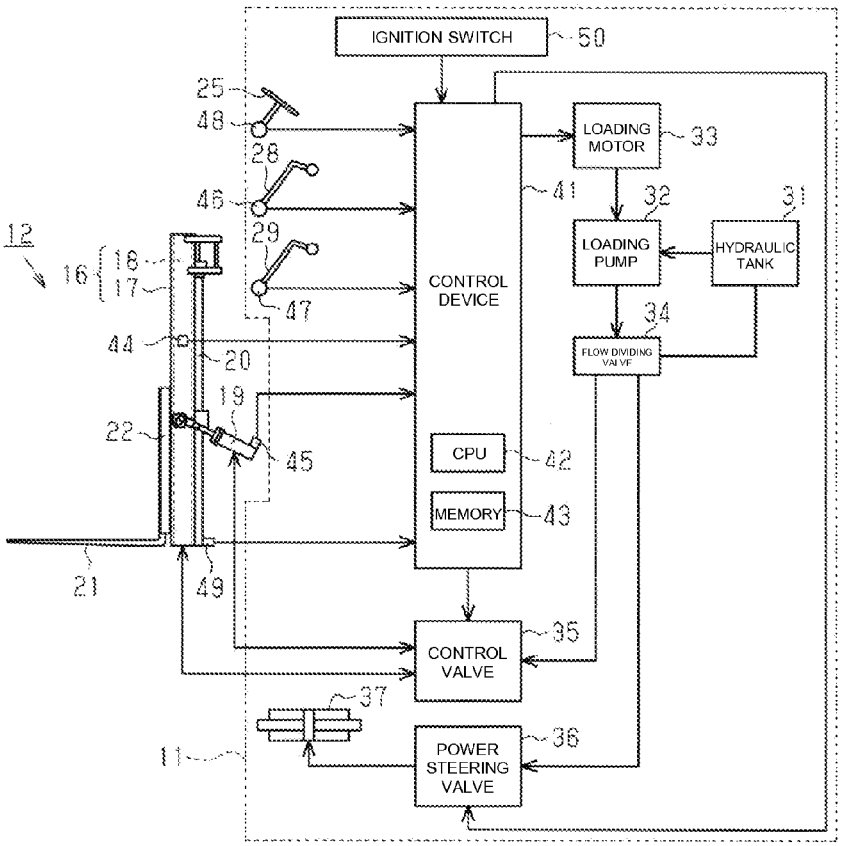
FIG. 3 is a block diagram showing a configuration of the forklift truck according to the first embodiment of the present invention.

As shown in FIG. 3, the vehicle body 11 has therein a hydraulic tank 31 that holds therein hydraulic oil and a loading pump 32 that pumps the hydraulic oil from the hydraulic tank 31. The loading pump 32 is connected with a loading motor 33 that drives the loading pump 32. In the first embodiment the flow rate of hydraulic oil that is pumped by the loading pump 32 is varied in accordance with the drive amount of the loading motor 33, that is, the rotation speed of the loading motor 33. A flow dividing valve 34 that divides flow of hydraulic oil is connected, on one hand, with the loading pump 32 and, on the other hand, to a control valve 35 and a power steering valve 36. A priority valve is used for the flow dividing valve 34. The hydraulic oil supplied to the flow dividing valve 34 from the loading pump 32 is preferentially supplied to the power steering valve 36. Specifically, the hydraulic oil supplied to the flow dividing valve 34 is supplied to the power steering valve 36 at a predetermined flow rate, and the control valve 35 is supplied with hydraulic oil at a flow rate that corresponds to the difference between the flow rate of the hydraulic oil supplied to the flow dividing valve 34 and the flow rate of the hydraulic oil supplied to the power steering valve 36. In other words, the power steering valve 36 is supplied with hydraulic oil at a predetermined flow rate irrespective of the delivery of the loading pump 32, that is, irrespective of the rotation speed of the loading motor 33.

The control valve 35 is connected with the tilt cylinder 19 and the lift cylinder 20. The control valve 35 controls the flow rate of hydraulic oil supplied to the tilt cylinder 19 and the lift cylinder 20, respectively. The tilt cylinder 19 and the lift cylinder 20 are driven at a speed according to the amount of hydraulic oil supplied per a predetermined unit of time, respectively.

A steering cylinder 37 is connected to the power steering valve 36. The power steering valve 36 controls the flow rate of hydraulic oil supplied to two hydraulic chambers formed on opposite sides of a piston of the steering cylinder 37.

The vehicle body 11 further has therein a control device 41 that controls the loading motor 33, the control valve 35, and the power steering valve 36. The control device 41 has therein a CPU (central processing unit) 42 that is configured to execute a control operation according to a predetermined procedure and a readable and rewritable memory 43. The memory 43 stores therein a control program for controlling the traveling and load handling operation of the forklift truck 10. The forklift truck 10 according to the first embodiment is configured to regulate the speed of lifting the forks 21 by regulating the flow rate of hydraulic oil supplied to the lift cylinder 20 when the mast assembly 16 is tilted forward. Fort this purpose, the memory 43 of the first embodiment stores therein data of a forward tilt angle of the mast assembly 16 at which the speed of lifting the mast assembly 16 is regulated, and of regulation of flow of the flow rate of hydraulic oil supplied to the lift cylinder 20 in regulating the lifting speed of the mast assembly 16. The control device 41 is connected with a first lifted height detection switch 44, a tilt angle sensor 45, a lift lever angle sensor 46, a tilt lever angle sensor 47, a steering angle sensor 48, a load sensor 49, and an ignition switch 50.

The first lifted height detection switch 44 is provided in the mast assembly 16. The first lifted height detection switch 44 detects a lifted height (a height position) of the forks 21. Upon detection of the forks 21 reaching a predetermined reference height (e.g. 2,000 mm from the ground surface), the first lifted height detection switch 44 outputs a detection signal to the control device 41. An example of the first lifted height detection switch 44 includes a limit switch. In the first embodiment, one first lifted height detection switch 44 is provided in the mast assembly 16. In the following description of the embodiment, the height position that is higher than the above reference height or the height position of the forks 21 that is detected by the first lifted height detection switch 44 that is higher than the reference height (e.g. 2,000 mm) is determined as a higher lifted height, and the height position that is equal to or lower than the reference height or the height position of the forks 21 detected by the first lifted height detection switch 44 that is equal to or lower than the reference height is determined as a lower lifted height. Specifically, in the first embodiment, the reference height is determined by the first lifted height detection switch 44. The first lifted height detection switch 44 determines whether the forks 21 are at a lifted height that is higher than the reference height, that is, a higher lifted height, or at a lifted height that is equal to or lower than the reference height, that is, a lower lifted height, based on thus determined reference height. In other words, the detection of the forks 21 by the first lifted height detection switch 44 is performed in a binary manner. Receiving a detection signal from the first lifted height detection switch 44, the CPU 42 of the control device 41 determines that the forks 21 are currently at a higher lifted height with respect to the reference height. When no detection signal is sent from the first lifted height detection switch 44, on the other hand, the CPU 42 determines that the forks 21 are at a lower lifted height with respect to the reference height.

The tilt angle sensor 45 as the tilt angle detector of the present invention is disposed in the vicinity of the tilt cylinder 19 and detects a tilt angle (a forward tilt angle or a backward tilt angle) of the mast assembly 16 with respect to the horizontal position of the forks 21 as a reference angle and outputs a detection signal that represents the detected tilt angle. An example of the tilt angle sensor 45 includes a potentiometer. Upon receiving the detection signal from the tilt angle sensor 45, the CPU 42 of the control device 41 determines the current tilt angle of the mast assembly 16.

The lift lever angle sensor 46 is mounted to the lift lever 28 and detects a lever angle (an operation amount) of the lift lever 28. The lift lever angle sensor 46 outputs a detection signal that represents the detected lever angle of the lift lever 28 to the control device 41. Receiving the detection signal from the lift lever angle sensor 46, the CPU 42 of the control device 41 determines the current lever angle of the lift lever 28.

The tilt lever angle sensor 47 is mounted to the tilt lever 29 and detects a lever angle (an operation amount) of the tilt lever 29. The tilt lever angle sensor 47 outputs a detection signal that represents the detected lever angle of the tilt lever 29 to the control device 41. Upon receiving the detection signal from the tilt lever angle sensor 47, the CPU 42 of the control device 41 determines the current lever angle of the tilt lever 29.

The steering angle sensor 48 is mounted to the steering wheel 25 and detects a steering angle (or an operation amount) of the steering wheel 25. The steering angle sensor 48 outputs a detection signal that represents the detected steering angle of the steering wheel 25 to the control device 41. Receiving the detection signal from the steering angle sensor 48, the CPU 42 of the control device 41 determines the current steering angle of the steering wheel 25.

The load sensor 49 is disposed in a hydraulic circuit at a position in the vicinity of the lower part of the lift cylinder 20. The load sensor 49 detects the hydraulic pressure in the lift cylinder 20 and outputs a detection signal that represents the load applied to the forks 21. The load sensor 49 may be provided, for example, by a pressure sensor. The CPU 42 of the control device 41 determines that a load is applied to the forks 21 based on the detection signal from the load sensor 49. In the first embodiment, the load sensor 49 detects the load on the forks 21 against the reference value that is zero (kg) when no load is applied to the forks 21. Specifically, the load sensor 49 is operable to detect the load in terms of negative values when the forks 21 receive a reaction force from the floor or the ground, as well as the positive values when a load is applied to the forks 21.

The ignition switch 50 may be turned on and off by an operator of the forklift truck 10 to start and stop the forklift truck 10. Upon detection of the ignition switch 50 being turned on, the control device 41 sets the drive source ready for driving the forklift truck 10. When the ignition switch 50 is turned off, the control device 41 stops the drive source.

The control device 41 calculates flow rate of hydraulic oil required for performing an operation instructed by an operator based on the current lever angle of the lift lever 28 (or the operation amount of the lift lever 28), the current lever angle of the tilt lever 29 (or the operation amount of the tilt lever 29), and the current steering angle of the steering wheel 25. The control device 41 then controls the rotation speed of the loading motor 33 so that the flow dividing valve 34 is supplied with hydraulic oil at the calculated flow rate and regulates the flow rate of hydraulic oil supplied to the respective cylinders 19, 20, 37 through the control valve 35 and the power steering valve 36. Each cylinder is driven at a speed corresponding to the amount of hydraulic oil supplied per a predetermined unit of time to the cylinder. The lift cylinder 20 is supplied with hydraulic oil at a flow rate that is determined by the current lever angle of the lift lever 28 and lifts and lowers the forks 21 at a speed determined by the flow rate of hydraulic oil supplied to the lift cylinder 20. The tilt cylinder 19 is supplied with hydraulic oil at a flow rate that is determined by the current lever angle of the tilt lever 29 and tilts the mast assembly 16 forward or backward at a speed that is determined by flow rate at which hydraulic oil is supplied to the tilt cylinder 19.

Figure 5:
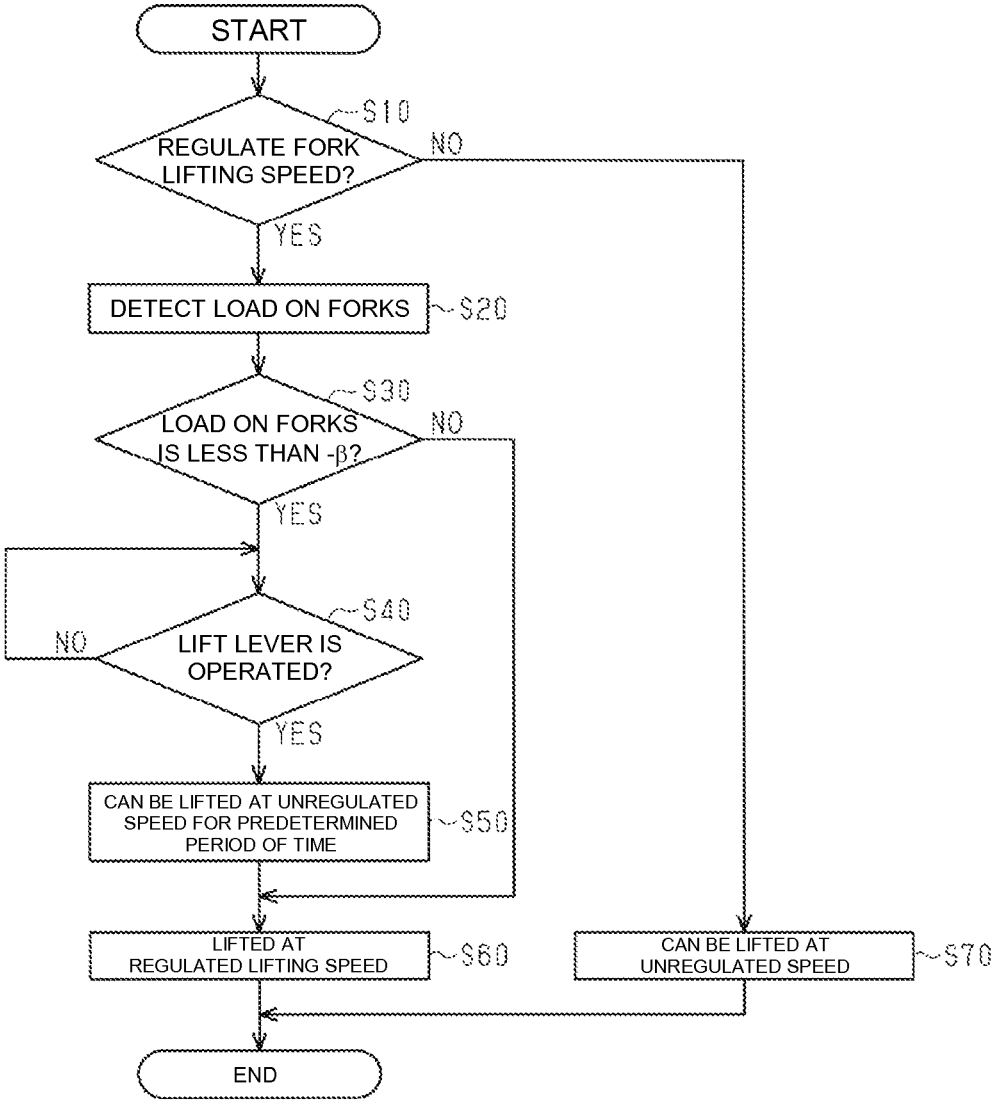
FIG. 5 is a flow chart showing a control program procedure executed by a control device of the forklift truck according to the first embodiment of the present invention.

The following will describe a control program procedure executed by the control device 41 when the mast assembly 16 is lifted, with reference to the flow chart of FIG. 5.

At step S10, the control device 41 makes a determination as to whether or not the fork lifting speed should be regulated based on the tilt angle of the mast assembly 16 and the lifted height of the forks 21. The regulation of the fork lifting speed is accomplished by regulating the flow rate of hydraulic oil to be supplied to the lift cylinder 20. If the control device 41 determines that the fork lifting speed should be regulated (Yes at S10), the program proceeds to step S20. If the control device 41 determines that the fork lifting speed should not be regulated (No at S10), the program proceeds to step S70.

At step S70, the control device 41 causes the forks 21 to be lifted at an unregulated lifting speed, that is, the lift cylinder 20 is supplied with hydraulic oil at a flow rate that is determined by the lever angle of the lift lever 28.

At step S20, the control device 41 determines the magnitude of the load applied to the forks 21 based on the detection signal sent from the load sensor 49, and the program proceeds to step S30. At step S30, the control device 41 determines whether or not the magnitude of the load applied to the forks 21 and detected by the load sensor 49 is smaller than a predetermined negative value of $\beta$ (or $-\beta$). In the case that the forks 21 are placed on the ground or floor, the load sensor 49 detects a load whose magnitude is smaller that of the load detected by the load sensor 49 when no load is present on the forks 21. It is to be noted that the load sensor 49 may temporarily read a negative value while the forks 21 are being lowered. However, such negative value is approximate to zero and greater than the value detected when the forks 21 are placed on the ground or floor. Therefore, in order not to cause erroneous detection while the forks 21 are being lowered, the predetermined value $-\beta$ that is smaller than the former negative value detected when the forks 21 are being lowered is used as a reference in determining whether the forks 21 are placed on the ground or not. Specifically, if the value of the load is smaller than $-\beta$, it is determined that the forks 21 are placed on the ground. An optimum value obtained through experiments is used for the value $-\beta$. If the value of the load applied to the forks 21 is smaller than $\beta$ (or $-\beta$) (Yes at S30), the program proceeds to step S40 and the control device 41 determines whether or not the operator of the forklift truck 10 has operated the lift lever 28 for lifting the forks 21. If the value of the load applied to the forks 21 is not smaller than $-\beta$ (No at S30), the program proceeds to step S60. If the operator of the forklift truck 10 operated the lift lever 28 for lifting the forks 21 (Yes at S40), the control device 41 determines that lifting of the forks 21 off the ground has been started. Specifically, the lifting of the forks 21 off the ground according to the first embodiment is initiated by operating the lift lever 28 so as to lift the forks 21 after it is determined at step S30 that the forks 21 are placed on the ground. The control device 41 corresponds to the determination device that determines whether or not the forks 21 are being lifted off the ground of the present invention. If the operator operates the lift lever 28 so as to lift the forks 21 (Yes at S40), the program proceeds to step S50. It is to be noted that the lifting operation of the load handling attachment off the ground herein refers to an operation in which the load handling attachment that is placed on the floor or the ground is lifted off the floor or the ground for traveling of the industrial vehicle.

At step S50, the control device 41, which has determined that the forks 21 are being lifted off the ground, permits the forks 21 to be lifted at an unregulated lifting speed for a predetermined period of time. Specifically, the lift cylinder 20 is supplied with hydraulic oil at a flow rate that is determined by the then lever angle of the lift lever 28. The predetermined period of time is a time that is required for the forks 21 to be lifted off the floor or the ground to a height that does not affect the traveling of the forklift truck 10 (i.e., a lifted height that does not cause dragging of the forks 21). The predetermined period of time may appropriately be set, for example, to a few seconds. At step S50, the control device 41 determines that the lifting of the forks 21 off the ground has ended after the predetermined period of time has elapsed, and the program proceeds to step S60.

At step S60, the control device 41 causes the forks 21 to be lifted at a speed that does not exceed the regulated lifting speed at step S10. In other words, the flow rate of hydraulic oil to be supplied to the lift cylinder 20 is regulated.

If it is determined by the control device 41 at step S40 that the lifting of the forks 21 off the ground is initiated (Yes at S40), the forks 21 are lifted at step S50 at an unregulated lifting speed for a predetermined period of time. If it is determined at step S30 that the forks 21 are not placed on the ground, on the other hand, the above determination is not made and the forks 21 are lifted at a regulated speed.

Figure 4:
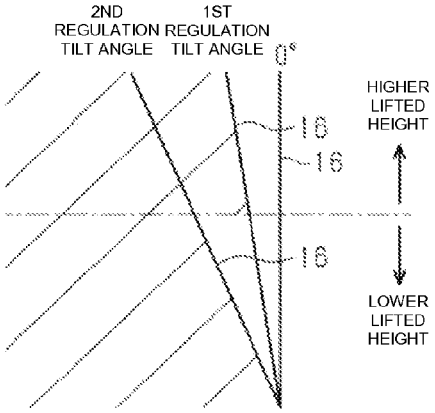
FIG. 4 is a schematic diagram showing regions in which the flow rate of hydraulic oil supplied to a lift cylinder of the forklift truck of FIG. 1 is regulated.

Conditions for regulating the fork lifting speed at step S10 will now be described with reference to FIG. 4 schematically showing the tilt angles of the mast assembly 16. In FIG. 4, the hatching represents regions of tilted angle of the mast assembly 16 in which the flow rate of hydraulic oil to be supplied to the lift cylinder 20 is regulated. As described earlier, the tilt angle of the mast assembly 16 is zero degrees when the forks 21 are positioned level.

Referring to FIG. 4, when the forward tilt angle of the mast assembly 16 is equal to or smaller than a first regulation tilt angle, hydraulic oil is supplied to the lift cylinder 20 at a flow rate that is determined by the lever angle of the lift lever 28. Specifically, the fork lifting speed is not regulated. The first regulation tilt angle is greater than zero degrees, that is, the mast assembly 16 at the first regulation tilt angle is tilted forward in the vehicle body 11. To be more specific, the first regulation tilt angle is set at such an angle that the forklift truck 10 with the mast assembly 16 at a tilt angle equal to or smaller than the first regulation tilt angle will not suffer from operational instability irrespective of whether the forks 21 are lifted to a lower lifted height or a higher lifted height with respect to the reference height. The first regulation tilt angle, which may be established through experiment, is set at about one degree in the present embodiment.

When the forward tilt angle of the mast assembly 16 is greater than the first regulation tilt angle and equal to or smaller than a second regulation tilt angle that is greater than the first regulation tilt angle, and when the forks 21 are at a higher lifted height, the flow rate of hydraulic oil to be supplied to the lift cylinder 20 is regulated. When the forward tilt angle of the mast assembly 16 is greater than the first regulation tilt angle and equal to or smaller than the second regulation tilt angle, and when the forks 21 are at a lower lifted height, on the other hand, the flow rate of hydraulic oil to be supplied to the lift cylinder 20 is not regulated. The second regulation tilt angle as the regulation tilt angle of the present invention is greater than the first regulation tilt angle, that is, the mast assembly 16 at the second regulation tilt angle is tilted forward of the first regulation tilt angle. As the second regulation tilt angle, two to four degrees may be determined and set based on experiments. The mast assembly 16 which is tilted forward to an angle that is greater than the second regulation tilt angle may affect the operational stability of the forklift truck 10 irrespective of the lifted height of the forks 21. In such tilted position of the mast assembly 16, the flow rate of hydraulic oil to be supplied to the lift cylinder 20 is regulated irrespective of the lifted height of the forks 21.

In the first embodiment, the tilt angle sensor 45 that detects the tilt angle of the mast assembly 16, the control device 41 that determines whether or not the fork lifting speed should be regulated and also determines whether or not the forks 21 are being lifted off the ground, and the load sensor 49 that detects a load applied to the forks 21 so as to determine whether or not the forks 21 are placed on the ground function as the apparatus for controlling the load handling device of the forklift truck 10 according to the present invention.

The operation of the apparatus for controlling the load handling device according to the first embodiment will now be described.

When the forks 21 are lifted from a lower lifted height to a higher lifted height with respect to the reference height, the first lifted height detection switch 44 detects that the forks 21 have been lifted higher than the reference height and outputs a detection signal to the control device 41. The control device 41 then determines that the forks 21 are at a higher lifted height with respect to the reference height.

When the forward tilt angle of the mast assembly 16 is greater than the first regulation tilt angle and equal to or smaller than the second regulation tilt angle, the control device 41 is operated to regulate the flow rate of hydraulic oil supplied to the lift cylinder 20 upon detecting that the forks 21 are at a higher lifted height. Specifically, the flow rate regulation is performed by controlling the rotation speed of the loading motor 33 and the control valve 35 appropriately so that the flow rate of hydraulic oil supplied to the lift cylinder 20 does not exceed the regulated flow rate. If the flow rate of hydraulic oil supplied to the lift cylinder 20 that is determined based on the lever angle of the lift lever 28 is greater than the flow rate that is regulated by the control device 41, the control device 41 is operated to regulate the flow rate of hydraulic oil supplied to the lift cylinder 20 so that the flow rate of hydraulic oil supplied to the lift cylinder 20 becomes equal to or smaller than the flow rate that is regulated by the control device 41.

By regulating the flow rate of hydraulic oil supplied to the lift cylinder 20, the extending speed of the lift cylinder 20 is reduced as the lifted height of the forks 21 becomes higher than the reference height. The operator then noticing that the reduced lifting speed of the forks 21 against the current lever angle of the lift lever 28 is warned of a potentially hazardous situation associated with instability of the forklift truck 10. Even if the operator tilts the mast assembly 16 backward from the current tilt angle to a forward tilt angle that is equal to or smaller than the first regulation tilt angle, the regulation of the flow rate of hydraulic oil supplied to the lift cylinder 20 is maintained. The regulation may be canceled on a condition that the forward tilt angle of the mast assembly 16 becomes equal to or smaller than the first regulation tilt angle and the lift lever 28 and the tilt lever 29, i.e., all the levers are returned to their respective neutral positions.

Furthermore, when the control device 41 determines that the forks 21 are at a higher lifted height with respect to the reference height, if the flow rate of hydraulic oil supplied to the lift cylinder 20 that is determined based on the lever angle of the lift lever 28 is equal to or smaller than the flow rate that is regulated by the control device 41, the control device 41 does not regulate the flow rate of hydraulic oil supplied to the lift cylinder 20, with the result that the lift cylinder 20 is supplied with hydraulic oil at a flow rate that is determined by the lever angle of the lift lever 28.

When the forks 21 at a lower lifted height are lifted to a higher lifted height with the forward tilt angle of the mast assembly 16 being greater than the second regulation tilt angle, the regulation of flow rate of hydraulic oil supplied to the lift cylinder 20 is effective for both cases when the forks 21 are at a lower lifted height and when the forks 21 are at a higher lifted height. The control device 41 then executes the same control as in the case where the forward tilt angle of the mast assembly 16 is greater than the first regulation tilt angle and equal to or smaller than the second regulation tilt angle, and the forks 21 are at a higher lifted height. When the mast assembly 16 at a forward tilt angle that is greater than the second regulation tilt angle is tilted backward to a forward tilt angle that is equal to or smaller than the second regulation tilt angle, and the forks 21 are moved from a higher lifted height to a lower lifted height at the angle, the regulation of the flow rate of hydraulic oil supplied to the lift cylinder 20 is maintained. The regulation may be canceled on a condition that the forward tilt angle of the mast assembly 16 is equal to or smaller than the second regulation tilt angle, the forks 21 are moved down to a lower lifted height, and, the lift lever 28 and the tilt lever 29, i.e., all the loading control levers are returned to their neutral positions.

As described earlier, the control device 41 regulates the lifting speed of the forks 21 according to the tilt angle of the mast assembly 16 and the lifted height of the forks 21. However, if the fork lifting speed is regulated at all times when the forward tilt angle of the mast assembly 16 is greater than the second regulation tilt angle, the efficiency of load handling operation is lowered. Specifically, when the ignition switch 50 of the forklift truck 10 is turned off, the forks 21 are lowered and the tip ends of the forks 21 are brought into contact with the ground. When the ignition switch 50 of the forklift truck 10 is turned on to start a load handling operation, the forks 21 are placed on the ground. Therefore, the forks 21 need to be separated from the floor or the ground to allow the forklift truck 10 to move. In this case, the fork lifting speed is regulated irrespective of whether or not the forks 21 are placed on the ground and whether or not the forks 21 have thereon no load. Therefore, longer time is required to lift the forks 21 even though the stability of the forklift truck 10 is ensured.

In the first embodiment, when it is determined that in lifting the forks 21 are placed on the ground, that is, when the lifted height of the forks 21 is very low, the forks 21 are lifted at an unregulated lifting speed. Therefore, during the lifting operation of the forks 21 performed first after it is determined that the forks 21 are placed on the ground, it is possible to lift the forks 21 at a speed that is faster than the regulated lifting speed. Even though it has been determined that the forks 21 are being lifted off the ground, the lifting speed of the forks 21 is controlled or regulated according to the tilt angle of the mast assembly 16 and the lifted height of the forks 21 after a predetermined period of time has elapsed after the start of the lifting operation of the forks 21. Therefore, the situation that the fork lifting speed is not regulated when the forks 21 at a lower lifted height are lifted to a higher lifted height is prevented.

According to the first embodiment, the following effects are obtained.

(1) It is so configured that when the forks 21 are determined as being lifted off the ground, the forks 21 are lifted at a speed that is faster than the regulated lifting speed. During the lifting operation the forks 21 that are placed on the ground off the ground to a height that does not affect the traveling of the forklift truck 10, the forks 21 can be lifted at a speed that is faster than the regulated lifting speed. While the forks 21 are being lifted off the ground, the lifted height of the forks 21 is then low, and the operational stability of the forklift truck 10 is ensured. Therefore, when the operational stability of the forklift truck 10 is enhanced and the stability of the forklift truck 10 is ensured, the fork lifting speed is not regulated, which prevents the operability in the load handling operation from being lowered.

(2) The load sensor 49 that is provided in the forklift truck 10 and is operable to determine the magnitude of the load on the forks 21 may be used for detecting as to whether or not the forks 21 are placed on the ground. This helps to reduce the number of components for use in the forklift truck 10.

(3) When detecting a load applied to the forks 21 by the load sensor 49, whether the forks 21 are placed on the ground or not is determined by determining whether or not the applied load is smaller than the predetermined value $-\beta$. The use of the predetermined negative value $-\beta$ permits the control device 41 to determine appropriately whether or not the forks 21 are placed on the ground.

(4) It is so configured that when the forks 21 are determined as being lifted off the ground, the fork lifting speed is not regulated, that is, the forks 21 are lifted at a speed that is determined by the lever angle of the lift lever 28 as in a normal operation. Therefore, the working efficiency of the forklift truck 10 while the forks 21 are being lifted off the ground is not affected.

Second Embodiment

Figure 6:
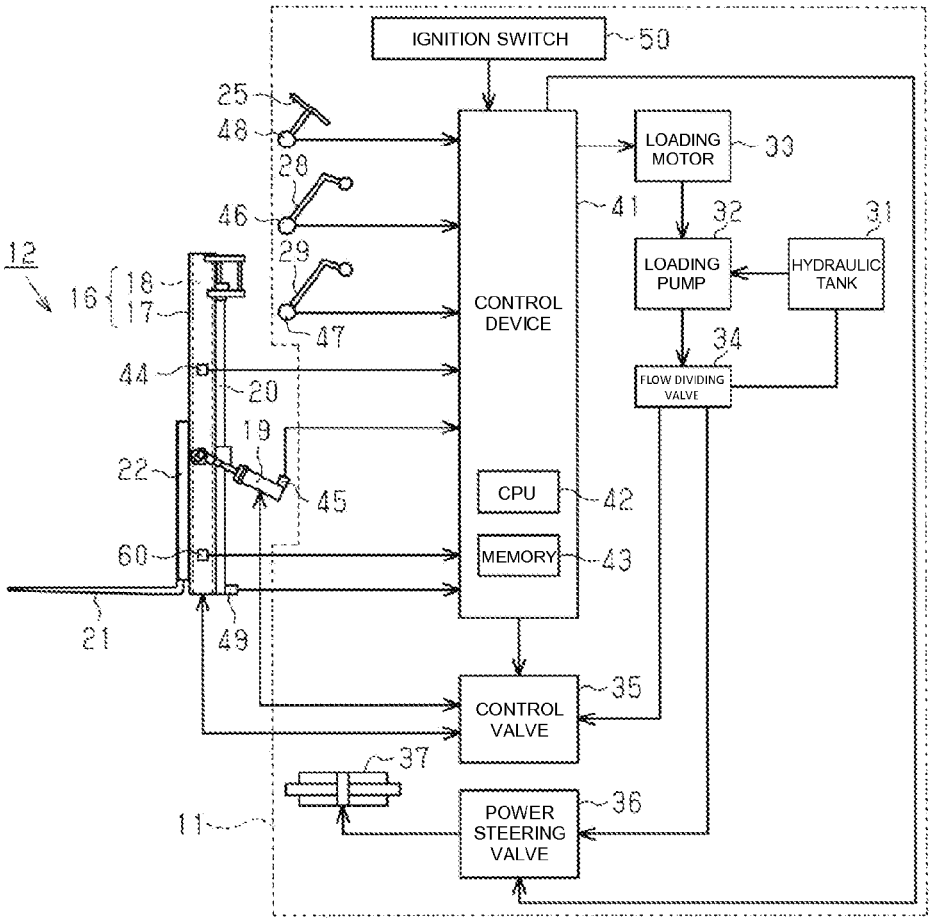
FIG. 6 is a block diagram showing a configuration of a forklift truck according to a second embodiment of the present invention.
Figure 7:
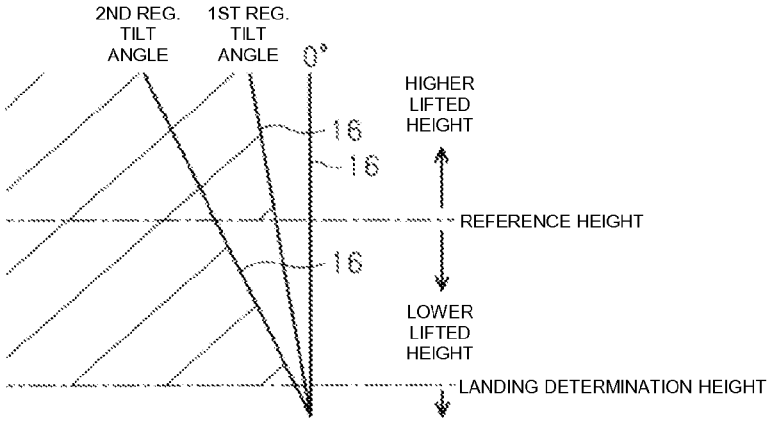
FIG. 7 is a schematic diagram showing regions in which the flow rate of hydraulic oil to be supplied to the lift cylinder is regulated in the forklift truck according to the second embodiment of the present invention.

The following will describe an apparatus for controlling a load handling device according to a second embodiment of the present invention with reference to FIGS. 6 and 7. In the following description, the parts or elements that are common to the first embodiment will be designated by the same numerals and the descriptions thereof will be omitted.

As shown in FIG. 6, a second lifted height detection switch 60 as the lifted height detector of the present invention is provided in the mast assembly 16. The second lifted height detection switch 60 detects a lifted height (a height position) of the forks 21 and outputs a detection signal when the forks 21 are lifted to a predetermined determination lifted height (e.g. 300 mm from the ground surface) as a reference for determining whether or not the forks 21 are being lifted off the ground. An example of the second lifted height detection switch 60 includes a limit switch. In the second embodiment, the mast assembly 16 is provided with one second lifted height detection switch 60. The CPU 42 (the determination device of the present invention) of the control device 41 determines by the lifting operation of the forks 21 up to the determination lifted height that is detected by the second lifted height detection switch 60 (e.g. up to 300 mm from the ground surface) that the forks 21 are being lifted off the ground. Specifically, the lifting operation of the forks 21 to a height that is equal to or lower than the determination lifted height can be considered as the lifting operation of the forks 21 placed on the floor or the ground to such an extent that traveling of the forklift truck 10 is not affected or a lifting operation that may be deemed as the above lifting operation, e.g. a lifting operation in which the forks 21 at a height that is higher than the ground level but lower than the determination lifted height are lifted while maintaining the stability of the forklift truck 10.

As shown in FIG. 7, the control device 41 does not regulate the fork lifting speed while the forks 21 are being lifted up to the determination lifted height. When the lifted height of the forks 21 is higher than the determination lifted height, if the mast assembly 16 is tilted and the forks 21 are lifted in the respective ranges according to the first embodiment in which the fork lifting speed is regulated, on the other hand, the control device 41 regulates the fork lifting speed.

According to the second embodiment, the following effect is obtained in addition to the effects obtained according to the first embodiment.

(5) The second lifted height detection switch 60 is provided in the mast assembly 16 so as to determine whether or not the lifted height of the forks 21 is equal to or lower than the determination lifted height. When it is determined that the lifted height of the forks 21 is equal to or lower than the determination lifted height and the forks 21 are being lifted, it is determined by the lifting operation of the forks 21 that the forks 21 are being lifted off the ground and then the control device 41 permits the forks 21 to be lifted at a speed faster than the regulated lifting seed.

The first and the second embodiments may be modified as follows.

In the first and the second embodiments, the determination of the operation of lifting the forks 21 off the ground is made based on the load applied to the forks 21 and the detection by the second lifted height detection switch 60. According to the present invention, however, it may be determined by the lifting operation of the forks 21 performed first after the ignition switch 50 is turned on that the forks 21 are being lifted off the ground. In this case, the control device 41 may permit the forks 21 to be lifted at an unregulated lifting speed for a predetermined period of time after the actuation of the ignition switch 50.

In the first and the second embodiments, when it is determined that the forks 21 are being lifted off the ground, the control device 41 permits the forks 21 to be lifted at a speed that is faster than the regulated lifting speed. According to the present invention, however, the forks 21 that are determined as being lifted off the ground may be lifted at a regulated speed that is less strict than the lifting speed that is regulated when the forward tilt angle of the mast assembly 16 is greater than the second regulation tilt angle. In such case, the forks 21 can be lifted at a speed faster than the regulated lifting speed.

In the first embodiment, the load sensor 49 is used for detection of whether or not the forks 21 are placed on the ground. However, a limit switch may be provided in the forks 21 to directly detect the contact of the forks 21 with the ground, or a laser distance sensor may be provided in the mast assembly 16 for the same detection purpose.

In the first embodiment, it may be so configured that the lifting speed is not regulated in lifting the forks 21 from a state in which the forks 21 are placed on a rack, as well as in lifting from a state in which the forks 21 are placed on the ground. As with the case in which the forks 21 are placed on the ground, the load sensor 49 reads a negative value in the case that the forks 21 are placed on the rack.

In the first and the second embodiments, it may be so configured that the fork lifting speed is regulated when the forward tilt angle of the mast assembly 16 is greater than the second regulation tilt angle and no first regulation tilt angle, at which the fork lifting speed is regulated when the forks 21 are at a higher lifted height, is set.

In the first and the second embodiments, it may be so configured that the lifting operation of the forks 21 is stopped when the forward tilt angle of the mast assembly 16 is greater than the second regulation tilt angle, which means that regulation of the lifting speed of the forks 21 includes stopping the lifting operation of the forks 21.

In the first and the second embodiments, a load handling attachment, such as a clamp and a ram, may be used instead of the forks 21.

In the first and the second embodiments, a switch that detects the lifted height of the forks 21 continuously may be used for the first lifted height detection switch 44. In this case, it may be so configured that regulation of the flow rate of hydraulic oil to be supplied to the lift cylinder 20 is increased with an increase of the lifted height of the forks 21. In other words, the regulated fork lifting speed may be decreased with an increase of the height of the forks 21.

In the first and the second embodiments, it may be so configured that the display device 26 shows the operator of the forklift truck 10 a warning sign indicating that the regulation of the flow rate of hydraulic oil supplied to the lift cylinder 20 is effected and also prompting the operator to tilt the mast assembly 16 backward.

In the first and the second embodiments, a loading pump supplying hydraulic oil to the power steering valve 36 (or the steering cylinder 37) and a loading pump supplying hydraulic oil to the lift cylinder 20 and the tilt cylinder 19 (or the control valve 35) may be separately provided. In this case, the flow dividing valve 34 may not be provided.

The flow rate of hydraulic oil to be delivered from the loading pump 32 to the flow dividing valve 34 is controlled by the rotation speed of the loading motor 33. According to the present invention, however, the loading pump 32 may be substituted by a variable delivery pump which requires no changing of the rotation speed.

In the case of a forklift truck that is powered by an engine in which the drive wheels 14 are driven by the traction force of the engine, the engine may be used as the drive that drives the loading pump 32.

The forklift truck 10 may be provided with an inclinometer that measures the angle of a slope. When the fork lift truck 10 is on a slope, the forks 21 are lifted with the mast assembly 16 inclined with respect to the slope. Therefore, load handling operation on a slope can be performed appropriately by measuring an angle of the slope with the inclinometer and obtaining the angle of the mast assembly 16 to be tilted taking the angle of the slope into consideration.

The forklift truck 10 may be provided with a lever for operating an attachment that is hydraulically driven as the load handling lever. Examples of an attachment include a fork side shifter adapted to change the spaced distance between the forks 21 and a roll clamp adapted to hold a roll of paper. In this case, the regulation of the flow rate of hydraulic oil supplied to the lift cylinder 20 may be cancelled by returning the lift lever 28, the tilt lever 29, and the lever for operating the attachment are returned to their neutral positions, as well as by tilting the mast assembly 16 backward to an angle that requires no regulation.

It may be configured such that the flow rate of hydraulic oil supplied to the tilt cylinder 19 and the flow rate of hydraulic oil supplied to the lift cylinder 20 are controlled individually. In this case, the regulation of the flow rate of hydraulic oil supplied to the lift cylinder 20 may be canceled on the condition that only the lift lever 28 is returned to its neutral position with the mast assembly 16 tilted backward to an angle at which the flow rate of hydraulic oil supplied to the lift cylinder 20 is not regulated. Since it may be so controlled that the flow rate of hydraulic oil supplied to the tilt cylinder 19 remains unchanged, the tilting speed of the mast assembly 16 remains unchanged without being influenced by the cancellation of the regulation.

What is claimed is:

1. An apparatus for controlling a load handling device of an industrial vehicle, the load handling device having a mast assembly and a load handling attachment attached to the mast assembly, the apparatus controls a tilting operation of the mast assembly and a lifting and lowering operation of the load handling attachment, the apparatus comprising:

a tilt angle sensor that detects a tilt angle of the mast assembly;

a controller programmed to:

control a lifting speed of the load handling attachment to be limited to a regulated lifting speed when a forward tilt angle of the mast assembly is greater than a predetermined regulation tilt angle; and determine whether or not the load handling attachment is being lifted off a ground position, wherein when the load handling attachment is being lifted off the ground position and the forward tilt angle is greater than the predetermined regulation tilt angle, the controller permits the load handling attachment to be lifted at a speed faster than the regulated lifting speed.

2. The apparatus for controlling the load handling device according to claim 1, further comprising a load sensor that detects a load on the load handling attachment, wherein when a load detected by the load sensor is smaller by a predetermined value or more than a load detected when no load is applied to the load handling attachment, the controller determines that the load handling attachment is placed on the ground position, and the load handling attachment is determined to be lifted off the ground position when the lifting operation of the load handling attachment is performed after determining that the load handling attachment is placed on the ground position.

3. The apparatus for controlling the load handling device according to claim 2, wherein when the load handling attachment is lifted off the ground position, the controller permits the load handling attachment to be lifted off the ground position at a speed that is faster than the regulated lifting speed for a predetermined period of time after a start of the lifting operation of the load handling attachment.

4. The apparatus for controlling the load handling device according to claim 1, further comprising a lifted height detector that detects a lifted height of the load handling attachment, wherein when the lifting operation of the load handling attachment is performed and the lifted height of the load handling attachment is equal to or lower than a determination lifted height, the controller determines that the load handling attachment is lifted off the ground position.

5. The apparatus for controlling the load handling device according to claim 1, wherein the controller is connected with an ignition switch for starting and stopping operation of the industrial vehicle, and when the lifting operation of the load handling attachment is performed first after the ignition switch is turned on, the controller determines that the load handling attachment is lifted off the ground position.

* * * * *